United States Patent [19]

Diebold et al.

[11] 4,100,016

[45] Jul. 11, 1978

[54] SOLVENT PULPING PROCESS

[75] Inventors: Vincent B. Diebold, Cincinnati, Ohio; Wavell F. Cowan, Montreal, Canada; John K. Walsh, Cincinnati, Ohio

[73] Assignee: C P Associates Limited, Montreal, Canada

[21] Appl. No.: 724,387

[22] Filed: Sep. 17, 1976

[30] Foreign Application Priority Data

Oct. 24, 1975 [CA] Canada ..... 238294

[51] Int. Cl.[2] ..... D21C 3/20

[52] U.S. Cl. ..... 162/16; 162/29; 162/40; 162/42; 162/68; 162/77

[58] Field of Search ..... 162/77, 68, 42, 16, 162/29, 40; 203/19

[56] References Cited

U.S. PATENT DOCUMENTS

| | | | |
|---|---|---|---|
| 1,856,567 | 5/1932 | Kleinert et al. | 162/77 |
| 2,003,347 | 6/1935 | Dreyfus | 162/77 |
| 2,037,001 | 4/1936 | Aronousky | 162/77 |
| 2,106,797 | 2/1938 | Dreyfus | 162/77 |
| 2,382,044 | 8/1945 | Fisher | 203/19 |
| 3,253,976 | 5/1966 | Bocci | 162/5 |
| 3,585,104 | 6/1971 | Kleinert | 162/77 |
| 3,887,426 | 6/1975 | Fogarassy | 162/77 |

OTHER PUBLICATIONS

Kleinert, T. N., "Organosolv Pulping With Aqueous Alcohol", TAPPI, vol. 57, #8, pp. 99–102.

*Primary Examiner*—S. Leon Bashore
*Assistant Examiner*—William F. Smith
*Attorney, Agent, or Firm*—Merriam, Marshall & Bicknell

[57] ABSTRACT

Solvent pulping of wood chips or other fibrous plant material is effected using an aqueous solution of a lower aliphatic alcohol in a plurality of batch extraction vessels. The charge in each vessel is heated rapidly to pulping temperature by recirculation of a primary extraction liquor having a relatively high dissolved solids content, and thereafter the charge is subjected to a series of once-through extractions or washes with successively cleaner liquors, including a final extraction or wash with fresh liquor. The extraction liquor from one extraction stage in one vessel is used in another extraction stage in another vessel. Upon completion of the extraction, the liquor is drained from the vessel, the vessel is depressurized to a solvent condenser, and the remaining solvent is steam stripped from the charge and recovered. The used extraction liquor is treated in an alcohol recovery system by flash vaporization, condensation of the solvent vapors, and vacuum stripping of the residual liquor with steam. The alcohol-free extract is then treated to recover a concentrated aqueous lignin suspension and a concentrated aqueous carbohydrate solution.

16 Claims, 2 Drawing Figures

SOLVENT PULPING PROCESS

Figure 1:
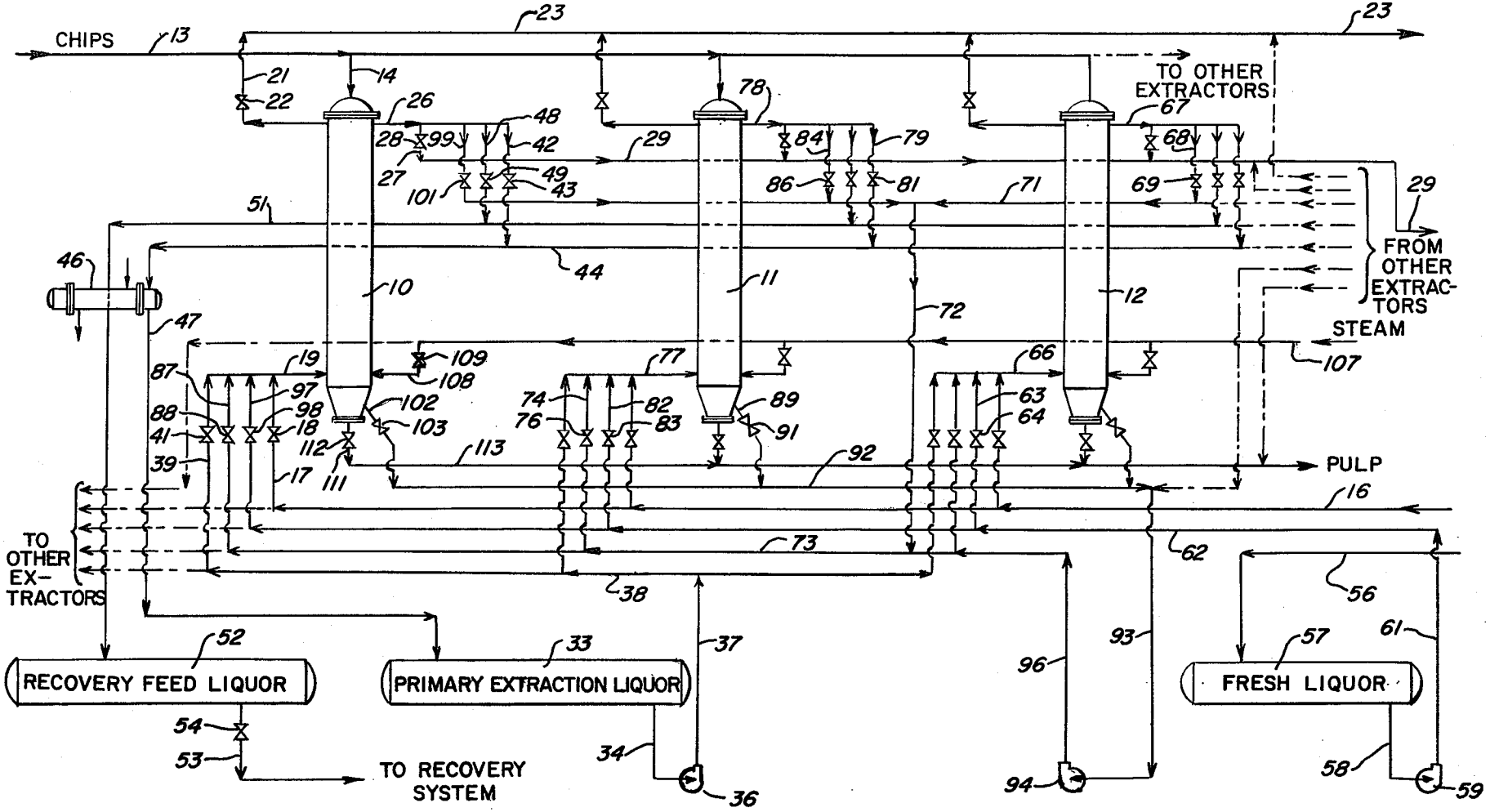

This invention relates to improvements in the production of cellulose pulp from wood or other fibrous plant material using an organic solvent as the pulping agent.

The principle of separating lignin from cellulose with solvents is well-known in the art, and processes have been proposed to utilize this essentially analytical tool to produce commercial pulp, for example, Kleinert et al U.S. Pat. No. 1,856,567 and Kleinert U.S. Pat. No. 3,585,104. However, such processes have shown serious limitations with respect to lignin removal, quality and ease of bleachability of the crude pulp, and difficulty with recovery of solvents and separation of the ligneous fraction therefrom.

By means of the present invention, however, it is possible to obtain separation and recovery of the cellulose and lignin fractions in a highly effective manner such that there is no appreciable air or stream pollution or solid waste resulting from the process. Moreover, the organic solvent is recovered with a high degree of efficiency for recycling to the process, thereby overcoming a major deterrent to the practical utilization of solvent pulping.

Although a variety of solvents can be used to remove lignin from cellulose, the present invention utilizes aqueous mixtures or solutions of any of the lower aliphatic alcohols, such as methanol, ethanol, isopropanol, normal propanol, or the butanols. In the preferred embodiment of the invention, ethanol is utilized because of the relative ease of recovery and absence of appreciable reaction between the ethanol and wood or other fibrous plant material. Some methanol is formed in the pulping process and the recycled solvent can be a mixture of methanol and ethanol, or methanol alone may be used advantageously.

The solvent extraction can be carried out over a range of solvent alcohol concentrations (in aqueous solution), from as little as about 20% by weight to as high as about 80% by weight, at pressures ranging from about 10 to about 50 atmospheres, and at temperatures ranging from about 160° to about 220° C. However, a preferred range of conditions comprises an alcohol concentration in water of from about 40% by weight to about 60% by weight, a pressure of from about 20 to about 35 atmospheres, and a temperature of from about 180° to about 210° C.

In accordance with the invention, lignin extraction and separation from crude cellulose with minimum redeposition of polymerized extracted lignin on the cellulose are achieved by (1) introducing into a batch extraction vessel containing a charge of wood chips or other fibrous plant material an alcohol-water mixture at a relatively low temperature so as to displace air from the vessel, (2) then effecting extremely rapid heating of the chip charge to the required pulping temperature in a primary extraction stage by recirculation of heated used extraction liquor so that the primary extraction stage is essentially isothermal, and (3) thereafter conducting a series of sequential once-through extractions or washes of the chip charge with successively cleaner alcohol-water fractions under isothermal conditions, including a final extraction or wash with fresh liquor. To avoid adverse effects on both the rate and extent of lignin extraction, the wood chips or other fibrous plant material should be brought up to extraction or pulping temperature in the primary extraction stage in not more than about 10 minutes and preferably in not more than about 5 minutes. To insure the maximum amount of lignin extraction with a minimum amount of redeposition of undesirable polymerized fractions, the extraction vessel should be designed so that there is a minimum of channeling and/or back-mixing of the alcohol-water solvent. Thus, the vessel may have a high aspect ratio (height to diameter ratio) in the range of from about 4:1 to about 15:1, and preferably on the order of about 10:1.

In order to permit charging of wood chips or other fibrous plant material to the pressurized solvent-water system with minimum loss of solvent and to provide minimum back-mixing with maximum extraction, the invention also utilizes a plurality of batch extraction vessels arranged in a sequential series so that solvent from one extraction stage in one vessel is used in another extraction stage in another vessel, as described in greater detail hereinafter.

As a further feature of the invention, the process is operated so that after extraction of lignin is complete in a given extraction vessel, residual alcohol-water solution is drained from the vessel, the pressure is reduced through an alcohol-water condensing system, and the remaining solvent is then stripped from the residual crude cellulose with steam or other suitable stripping agent while the crude cellulose is still in the extraction vessel, the stripped vapors being carried out of the extraction vessel to the alcohol-water condensing system. The crude cellulose pulp is then discharged from the extraction vessel by sluicing with water. The crude pulp is not only delignified but is also thoroughly washed and stripped substantially completely of solvent. The crude pulp is of high quality and after defiberization is very readily bleached by conventional methods to produce high grades of bleached pulp suitable for a variety of uses.

For further recovery of solvent, the final extract solution from the solvent extraction section of the process is subjected to a stripping operation to remove and recover the alcohol from the aqueous extract solution. In order to accomplish this separation while minimizing development of tars or highly polymerized solid forms of lignin which would tend to foul the equipment, the separation is carried out under vacuum after first subjecting the extract solution to an equilibrium flash vaporization. This vacuum should be as low as possible, but practically speaking the vacuum may be from about 0.1 atm. to about 0.8 atm. and preferably in the neighborhood of 0.5 atm. at which level the resulting temperature is such that the ligneous precipitate, which develops as the alcohol is stripped, is carried through the stripping unit in suspension.

After stripping of the alcohol from the extract solution, the residual aqueous lignin slurry may be processed by conventional means. However, improved results are obtained by first settling the lignin slurry and then concentrating the thickened lignin slurry in a separating device, such as a solid bowl centrifugal, with the resulting lignin sludge or cake being suitable for combustion as a fuel in conventional furnaces and boilers. The supernatant aqueous liquor, containing essentially sugars, hemicelluloses, organic acids and small amounts of low molecular weight lignin fractions, is then evaporated by conventional means. The evaporation operation is relatively free from scaling or fouling of the equipment because of the absence of high molecular weight lignins or lignin polymers.

The sugar-carbohydrate concentrate at from 50–70% solids, and preferably at about 60% solids content, may be sold for by-product use such as animal feed or converted to other chemical or biological products. Where such by-product use is not feasible, this concentrate can also be burned in a conventional furnace or boiler to recover its fuel value in the form of steam which can be used in the aforementioned alcohol stripping step. The burning of the lignin sludge and the aqueous sugar concentrate can be carried out by mixing the two streams, which will yield a mixture similar in characteristics to a light fuel oil, except for a lower heat of combustion value. However, the combustion of this mixture will not yield undesirable polluting combustion products such as sulfur compounds, chlorides and the like, nor will there be any appreciable particulate problem common to conventional pulping methods, as the only solid resulting from the combustion operation is that equivalent to the relatively low ash content of the wood or other fibrous plant material being pulped.

Thus, the improved alcohol-pulping process of the present invention yields not only a high grade and readily bleached pulp, but if the lignin and/or the sugar-carbohydrate fractions are not salable as by-products, they can be used as fuel to make the process essentially self-sustaining from an energy standpoint. The essentially complete elimination of pollutants from combustion of the pulping wastes is another major advantage of the process. The moderate BOD content of the evaporator condensate can be treated readily by conventional secondary treatment means to yield an essentially pollution-free pulping operation.

Figure 2:
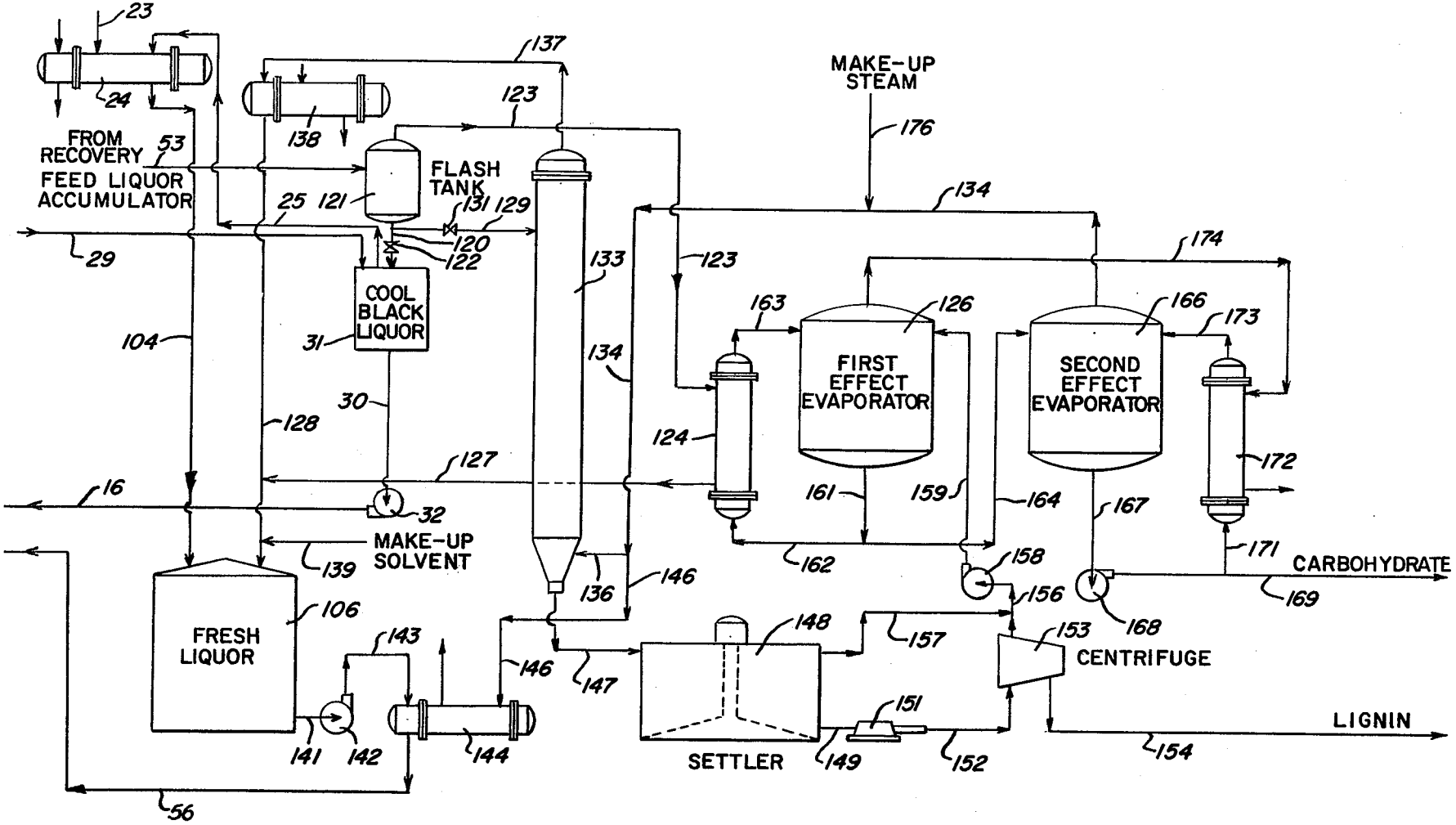

A specific example of the practice of the present invention is illustrated in the drawings, wherein:

FIG. 1 is a schematic process flow diagram illustrating the solvent extraction stages of the invention; and FIG. 2 is a schematic process flow diagram which is a continuation of FIG. 1 and illustrates the solvent recovery stage of the invention and also a preferred method of handling the waste products.

Referring to the drawings, FIG. 1 illustrates the solvent extraction portion of the process utilizing a plurality of batch extraction vessels. In an exemplary commercial embodiment, nine such vessels may be used, and each vessel operates on a three hour cover-to-cover cycle and is sequenced so that a completed batch of crude cellulose pulp is discharged from one of the vessels every 20 minutes. For convenience, only three such vessels are illustrated in FIG. 1 in the form of elongated tubular extractors 10, 11 and 12. To avoid problems with channeling and/or backmixing of liquor, the height:diameter ratio of the extractors should be relatively high, as previously pointed out.

Each extractor undergoes a sequence of operations which may be described briefly as (1) chip filling, (2) air displacement, (3) rapid heat-up by recirculation of primary extraction liquor, (4) at least one used liquor wash, (5) final fresh liquor wash, (6) depressurization and steaming, and (7) pulp discharge. It will be understood that at any given time, each extractor will be at a different stage of the processing operation, and the sequencing in each extractor may be accomplished automatically by conventional controls and instrumentation. Although the required piping for operation of the three extractors 10, 11 and 12 is illustrated in FIG. 1, it will suffice to describe a complete operating cycle for only one of the extractors.

Thus, the extractor 10 is first charged with wood chips which may be pneumatically conveyed through a supply header 13 and a branch line 14 to the extractor 10. After completion of the chip filling step, air is purged from the extractor 10 by means of a suitable relatively cool pulping or extraction liquor. In the illustrated embodiment, a relatively cool "spent" pulping or extraction liquor is introduced into the bottom of the extractor 10 from a supply header 16, a branch line 17 having a valve 18, and an inlet header 19. In accordance with conventional pulping terminology, this liquor will be referred to as "black liquor". The displaced air passes from the upper portion of the digester 10 through an outlet header 26, a branch line 27 having a valve 28, and a return header 29 to a cool black liquor storage tank 31 (FIG. 2). From the tank 31 the air passes by a line 25 to a condenser 24 and is there vented to the atmosphere by suitable vent means (not shown).

The step of displacing air from the extractor is necessary to prevent severe flashing when high temperature-high pressure extraction liquor is subsequently introduced into the extractor. As hereinafter explained, a convenient source of cool black liquor for the air displacement step is the storage tank 31 (FIG. 2) from which the liquor at a relatively low temperature, e.g. about 80° C., is withdrawn by a pump 32 and supplied to the header 16. However, any convenient liquor may be used for purging air from the extractors, e.g. clean alcohol-water solvent which may be supplied from the fresh liquor tank 106 (hereinafter described). As an incident to the air displacement step, the chips in the extractor are immersed for a short time in and are impregnated with the cool displacement liquor.

As soon as the extractor 10 is filled, the valve 18 is closed so as to terminate the flow of cool black liquor through the extractor, and primary extraction liquor comprising a used solvent mixture having a relatively high dissolved solids content and at the desired extraction temperature and pressure is then introduced into the bottom of the extractor 10. The primary extraction liquor is fed from an accumulator 33 by means of a line 34, a pump 36, a line 37, a supply header 38, a branch line 39 having a valve 41, and the inlet header 19. The extractor being full of cool black liquor is instantly pressurized with little or no flashing. The cool black liquor is displaced and is returned from the top of the extractor 10 through header 26, line 27, and header 29 to the black liquor storage tank 31. At this point the valve 28 is closed and the outlet flow is switched so that the primary extraction liquor flows from the extractor 10 through header 26, a branch line 42 having a valve 43, and a header 44 to a peak load heater 46. From the heater 46 the primary extraction liquor returns through a line 47 to the accumulator 33.

During the first portion of the period in which the primary extraction liquor is recirculated through the extractor 10 and the heater 46 in series, the circulation is carried out at a high flow rate and with a high input of heat through the heater 46 in order to bring the chip charge in the extractor up to cooking temperature in a very short period of time. For example, the flow rate and the heat input are such that the preferred extraction temperature of from about 180° to about 210° C is obtained in the extractor in preferably not more than about 5 minutes and, in any event, in not more than about 10 minutes. Once the chip charge is up to cooking temperature, the recirculation of the primary extraction liquor at a high flow rate is continued for the remainder of the primary extraction period but with a greatly reduced heat input through the heater 46. In general, the heat input during this time will be sufficient to make up for heat losses so as to maintain essentially isothermal extraction conditions in the extractor 10. Thus, a very uniform cooking environment is realized during the primary extraction period and a very high delignification rate is maintained with the result that on the order of 70–80% of the total lignin removal from the chips is achieved during the primary extraction period. Toward the end of the primary extraction period, the valve 43 is closed and the effluent extraction liquor from the extractor passes from the outlet header 26 and a line 48 having a valve 49 to an outlet header 51 communicating with a recovery feed liquor accumulator 52. As hereinafter described, the used extraction liquor is fed continuously under pressure from the accumulator 52 through a line 53 having a valve 54 to the alcohol recovery system.

As previously mentioned, the recirculation of used extraction liquor having a relatively high dissolved solids content accomplishes a major proportion of the lignin removal during the primary extraction period. Thereafter, the chip charge is subjected to one or more extractions or washes on a once-through basis, i.e. without recirculation, and each such once-through wash is carried out with a liquor having a successively lower dissolved solids content until the final once-through wash is carried out with fresh substantially lignin-free liquor. In the specific embodiment herein illustrated, after the primary extraction period during which the liquor is recirculated at a high rate, the chip charge is then subjected to one intermediate once-through wash with a liquor of reduced dissolved solids content and thereafter to a final once-through wash with fresh liquor. However, it is to be understood that any desired number of intermediate once-through washes may be utilized.

Thus, while extractor 10 is in its primary extraction period, as just described, extractor 11 is in its intermediate once-through extraction or wash period and extractor 12 is in its final once-through extraction or wash period. Heated fresh solvent or extraction liquor is supplied through a line 56 from the alcohol recovery system, as hereinafter described, to a fresh extraction liquor accumulator 57. The fresh liquor is withdrawn through a line 58 by pump 59 and is fed through a line 61 to a supply header 62 and then through a branch line 63 having a valve 64 to an inlet header 66 and upwardly through the extractor 12 containing another chip charge. The effluent liquor having a relatively low dissolved solids content leaves the top of the extractor 12 through an outlet header 67 and a branch line 68 having a valve 69 to a header 71. From header 71 the liquor flows through a line 72 to another header 73 and thence through a branch line 74 having a valve 76 to an inlet header 77 communicating with the bottom of the extractor 11 containing still another chip charge. The used liquor having an increased dissolved solids content leaves the top of the extractor 11 through an outlet header 78 and flows through a branch line 79 having a valve 81 to the header 44 where the liquor is combined with the effluent recirculating liquor from the extractor 10. Thus, it will be seen that fresh liquor flows in series through extractors 12 and 11 and then becomes part of the primary extraction liquor being recirculated through the extractor 10 and the heater 46. The liquor thus supplied to the accumulator 33 compensates for the portion of the primary extraction liquor which is diverted to the recovery feed liquor accumulator 52 toward the end of the primary extraction period.

Returning to the description of the flow through extractor 10, at the conclusion of the primary extraction period described above, the necessary valves are switched so that fresh liquor from the header 62 is now passed through a branch line 82 having a valve 83 to the inlet header 77 and thence through the extractor 11. The effluent liquor from extractor 11 flows through the outlet header 78, a branch line 84 having a valve 86, the header 71, the line 72, the header 73, a branch line 87 having a valve 88, and the header 19 into the bottom of the extractor 10. From the top of the extractor 10, the effluent liquor flows through the outlet header 26 and the branch line 42 to the header 44 as part of the recirculating primary extraction liquor which is now being supplied from the header 38 to another extractor of the system which is in its primary extraction period. The flow rate through the extractor 10 during subsequent once-through extraction or wash periods is substantially less than in the primary or recirculation extraction period, and although delignification continues during the secondary extraction period at a rapidly declining rate, the principal effect in this period is the diffusion of dissolved solids in the chips into the percolating wash liquor under the influence of the imposed concentration gradient. Toward the end of the secondary extraction or wash period, the flow of fresh liquor to extractor 11 is terminated, and the liquor in the extractor is drained through a line 89 having a valve 91 to a header 92 and thence through a line 93 to a pump 94 which is connected by line 96 to the header 73. From the header 73 the liquor passes through line 87 and header 19 to the extractor 10 and thence through the header 26 and the line 42 to the primary liquor circuit previously described.

By appropriate valve switching, extractor 10 now enters in its final extraction or wash period using fresh liquor. Thus, fresh liquor is now supplied from the accumulator 57 through the header 62, a branch line 97 having a valve 98, and the header 19 to the bottom of the extractor 10. Effluent liquor from the top of the extractor 10 passes through the header 26, a branch line 99 having a valve 101, the header 71, and the line 72, to the header 73 from which the liquor then flows through another extractor of the system which is in its secondary extraction or wash period. Delignification continues to a minor extent during the final extraction period, but again the primary effect achieved is the washing out of dissolved solids from the chips so that toward the end of the final extraction period the residual dissolved solids in the chips is quite low. Toward the end of the final extraction period, the flow of fresh liquor to the extractor 10 is terminated, and the liquor in the extractor 10 is drained through a line 102 having a valve 103 to the header 92 and is thence supplied through line 93, pump 94, line 96, and header 73 to the succeeding extractor of the system which is in its secondary extraction or wash period.

The chips in the extractor 10 having been subjected to a primary recirculating extraction stage and two successive once-through washes with used liquor and fresh liquor, respectively, are now ready to be discharged from the extractor 10. First, however, the extractor is subjected to controlled depressurization in which the solvent vapors in the extractor 10 are vented through a branch line 21 having a valve 22 to a vent header 23 and thence to the recovery system illustrated in FIG. 2. As shown there, the alcohol-rich vapors leaving the extractor pass through the blow-down condenser 24 to form a condensate which passes through a line 104 to a fresh liquor storage tank 106. After depressurization, steam stripping of the chips in the extractor 10 is carried out by introducing low pressure steam from a supply header 107 and a branch line 108 having a valve 109 into the bottom of the extractor 10. The steam flows upwardly through the chip charge thereby stripping out the residual alcohol, and the mixture of steam and alcohol vapor passes through the line 21 and the header 23 to the blow-down condenser 24, just as during the depressurization step. The steaming operation continues until only trace amounts of alcohol are left in the chips.

Upon completion of the steaming operation, the extractor 10 is pumped full of water (by means not shown) and thereafter the mixture of water and crude pulp is drained from the bottom of the extractor through a branch line 111 having a valve 112 to an outlet header 113 and thence to a pump (not shown) which transfers the crude pulp to conventional papermaking steps. Water injection nozzles may be provided in the extractor at suitable locations to insure complete discharge of the pulp from the extractor. After the extractor has been emptied, it is ready to be filled again with chips for another pulping sequence as described above.

Although the time schedule may be varied to meet the requirements of a particular solvent pulping operation, a typical schedule for a single extractor operating on a three hour cover-to-cover cycle is shown in the following table I:

TABLE I

| Time (Min.) | Operation | |
|---|---|---|
| 0–15 | (A) | Fill with chips. |
| 15–20 | (B) | Air displacement with cool black liquor. |
| 20–25 | (C) | Displacement of cool black liquor, and recirculation of primary extraction liquor for rapid heat-up. |
| 25–40 | (D) | Recirculation of primary extraction liquor at pulping temperature, and diversion of primary extraction liquor to recovery feed accumulator. |
| 40–53 | (E) | Once-through wash with secondary extraction liquor. |
| 53–60 | (F) | Continuation of (E) with secondary extraction liquor drained from previous extractor. |
| 60–73 | (G) | Once-through wash with fresh extraction liquor. |
| 73–80 | (H) | Pump-out of drain liquor. |
| 80–110 | (I) | Depressurization. |
| 110–165 | (J) | Steam stripping. |
| 165–180 | (K) | Fill with water, and discharge |

TABLE I-continued

| Time (Min.) | Operation |
|---|---|
| | of water-pulp mixture |

On the basis of the time schedule for each operation set forth in Table I, the complete cycle schedule for a nine extractor system is shown in the following Table II:

TABLE II

| Operation | (A) | (B) | (C) | (D) | (E) | (F) | (G) | (H) | (I) | (J) | (K) |
|---|---|---|---|---|---|---|---|---|---|---|---|
| | | | | Time (Min.) Interval For Each Operation | | | | | | | |
| Extractor #1 | 160–175 | 175–180 | 0–5 | 5–20 | 20–33 | 33–40 | 40–53 | 53–60 | 60–90 | 90–145 | 145–160 |
| Extractor #2 | 0–15 | 15–20 | 20–25 | 25–40 | 40–53 | 53–60 | 60–73 | 73–80 | 80–110 | 110–165 | 165–180 |
| Extractor #3 | 20–35 | 35–40 | 40–45 | 45–60 | 60–73 | 73–80 | 80–93 | 93–100 | 100–130 | 0–5<br>130–180 | 5–20 |
| Extractor #4 | 40–55 | 55–60 | 60–65 | 65–80 | 80–93 | 93–100 | 100–113 | 113–120 | 120–150 | 0–25<br>150–180 | 25–40 |
| Extractor #5 | 60–75 | 75–80 | 80–85 | 85–100 | 100–113 | 113–120 | 120–133 | 133–140 | 140–170 | 0–45<br>170–180 | 45–60 |
| Extractor #6 | 80–95 | 95–100 | 100–105 | 105–120 | 120–133 | 133–140 | 140–153 | 153–160 | 0–10<br>160–180 | 10–65 | 65–80 |
| Extractor #7 | 100–115 | 115–120 | 120–125 | 125–140 | 140–153 | 153–160 | 160–173 | 173–180 | 0–30 | 30–85 | 85–100 |
| Extractor #8 | 120–135 | 135–140 | 140–145 | 145–160 | 160–173 | 173–180 | 0–13 | 13–20 | 20–50 | 50–105 | 105–120 |
| Extractor #9 | 140–155 | 155–160 | 160–165 | 165–180 | 0–13 | 13–20 | 20–33 | 33–40 | 40–70 | 70–125 | 125–140 |

Referring to FIG. 2, the used extraction liquor flows under pressure from the accumulator 52 through line 53 to a flash drum 121 where the pressure is reduced resulting in partial vaporization of the alcohol solvent and cooling of the residual liquor. A portion of the residual black liquor at a relatively low temperature, e.g. about 80° C, may be passed through a line 120 having a valve 122 to the cool black liquor storage vessel 31 which is vented to the condenser 24 through a line 25. As previously described, when the cool black liquor is selected for purging air from the extractors, it is supplied from the vessel 31 by a line 30 and pump 32 to the supply header 16, and the liquor is returned to the vessel 31 through the header 29. The vaporized solvent passes from the flash drum 121 through a line 123 to a reboiler or heat exchanger 124 associated with a first effect evaporator 126. The alcohol vapors are condensed in heat exchanger 124, and the condensate passes by way of line 127 and a line 128 to the fresh liquor storage tank 106.

The major portion of the residual cool black liquor flows from the flash tank 121 through a line 129 having a valve 131 and is introduced into the upper portion of a vacuum stripping tower 133. Vacuum operation is desirable in order to reduce the temperature of the slurry so that the precipitated lignin will not stick and deposit onto the tray surfaces of the stripping tower. If desired, the liquor withdrawn from the flash tank 121 may be clarified to eliminate any precipitated lignin before it is passed to the stripping tower 133. Steam is supplied to the bottom of the vacuum stripping tower 133 through a line 134 from an evaporator 166, hereinafter described, and a line 136. Steam and alcohol vapors from the top of the tower 133 pass by line 137 to a condenser 138, and the resultant condensate passes through the line 128 to the fresh liquor storage tank 106. Although not shown in the drawing, it will be understood that part of the condensate from the condenser 138 may be returned to the top of the stripping tower 133 if a rectification section is desired in the top of the tower.

As will be apparent, the fresh liquor supply in the tank 106 comprises the overhead vapor condensate from the extractors introduced through the line 104, the condensed vapors from the flash drum 121 introduced through the lines 127 and 128, and the condensed overhead vapors from the tower 133 introduced through the line 128. In addition, make-up alcohol may be added to the fresh liquor supply through a line 139. Fresh liquor is withdrawn from the storage tank 106 through a line 141 by means of a pump 142 and is discharged through a line 143 into a heater 144 which is heated by steam from the line 134 and a line 146. The heated fresh liquor then flows through the line 56 to the fresh liquor accumulator 57.

A bottoms stream is withdrawn from the tower 133 through a line 147. This stream consists of a water slurry containing precipitated solids (essentially lignin) and dissolved materials which are predominantly carbohydrate in nature. The aqueous slurry passes from the line 147 to a thickener or settler 148 where the precipitated lignin settles out at about 5–15% solids leaving a clarified aqueous carbohydrate solution as the supernatant layer. A bottoms slurry is removed from the clarifier 148 through a line 149 by means of a pump 151 and is discharged through a line 152 into a centrifuge 153 where the slurry solids are increased, e.g. to about 30–40%. A concentrated aqueous lignin suspension is removed from the centrifuge 153 through a line 154.

The clear flow from the centrifuge 153 is removed through a line 156 and is combined with the supernatant clear liquor flowing from the top of the clarifier 148 through a line 157. The combined liquors are pumped by pump 158 through a line 159 to the first effect evaporator 126. Heat is supplied to the evaporator 126 by recycling a portion of the concentrated liquor through a line 161 and a line 162 through the reboiler 124 and thence through a line 163 back to the evaporator 126. The remainder of the concentrated liquor from the first evaporator 126 flows through the line 162 and a line 164 to second effect evaporator 166 where a concentrate containing about 40–50% solids is obtained. The concentrated liquor is withdrawn through a line 167 by pump 168, and a portion of this liquor is recycled through a line 169 and a line 171 to a reboiler 172 and thence through a line 173 back to the evaporator 166. The reboiler 172 is heated by overhead vapors passing from the first evaporator 126 through a line 174. The remainder of the concentrated stream from the evaporator 166 is withdrawn through the line 169 as an aqueous carbohydrate concentrate. The steam removed from the second effect evaporator 166 through the line 134 will normally be sufficient to supply the requirements of the stripping column 133 and the heater 144, but if needed, make-up steam can be added through a line 176.

By the foregoing waste handling system, it will be seen that the aqueous lignin suspension and the aqueous carbohydrate solution are concentrated separately, thereby eliminating fouling of the evaporator tubes by lignin. If lignin and carbohydrate by-products are economically desirable, the streams removed through lines 154 and 169 may be processed further. Otherwise, the two streams may be combined and delivered to a waste disposal boiler where their energy values are recovered as process steam.

We claim:

1. In a solvent extraction pulping process wherein lignin is extracted from subdivided fibrous plant material by contacting said material at an elevated pulping temperature and pressure with a solvent pulping liquor comprising an aqueous solution of a lower aliphatic alcohol, the improvement which comprises providing a plurality of batch extractors and carrying out the following sequential steps in each extractor:

(a) feeding a first charge of said subdivided fibrous plant material to a first extractor;

(b) filling said first extractor with a first used pulping liquor so as to displace air from said first extractor;

(c) introducing a second used pulping liquor of relatively high dissolved solids content at an elevated temperature and pressure into said first extractor so as to displace said first used pulping liquor, and recirculating said second used pulping liquor without separation of lignin at a relatively high velocity through said first extractor and through an external heat exchanger so as to effect rapid heating of said first charge to a predetermined pulping temperature of from about 160° to about 220° C. within not more than about 10 minutes at a predetermined pulping pressure of from about 10 to about 50 atmospheres, said second used pulping liquor being obtained from step (e), as hereinafter described, during pulping of another charge in a second extractor and being supplied from said second extractor to said first extractor without separation of lignin;

(d) continuing said recirculation of said second used pulping liquor without separation of lignin to effect essentially isothermal initial extraction of said first charge at said predetermined pulping temperature and pressure, and thereafter withdrawing said second used pulping liquor from said first extractor;

(e) flowing at least one additional used pulping liquor through said first charge in said first extractor on a once-through basis to effect essentially isothermal further extraction of said first charge at said predetermined pulping temperature and pressure, said additional used pulping liquor having a lower dissolved solids content than said second used pulping liquor and being obtained from step (f), as hereinafter described, during pulping of still another charge in a third extractor and being supplied from said third extractor to said first extractor without separation of lignin;

(f) flowing heated fresh pulping liquor through said first charge in said first extractor on a once-through basis to effect essentially isothermal final extraction of said first charge; and (g) discharging crude cellulose pulp from said first extractor.

2. The process of claim 1 wherein said alcohol is selected from the group consisting of ethanol, methanol, and mixtures thereof, and the concentration of said alcohol is from about 20% to about 80% by weight.

3. The process of claim 2 wherein the concentration of said alcohol is from about 40% to about 60% by weight.

4. The process of claim 1 wherein said predetermined pulping temperature is from about 180° to about 210° C. and said predetermined pulping pressure is from about 20 to about 35 atmospheres.

5. The process of claim 1 wherein each of said extractors comprises an elongated vertical tubular vessel, the pulping liquors being passed upwardly through said vessel, and said vessel having a height:diameter ratio between about 4:1 and about 15:1.

6. The process of claim 1 further comprising the following steps between steps (f) and (g):

draining liquor from said first extractor, depressurizing said first extractor by releasing the solvent vapors therein to a condenser, and recovering condensed solvent suitable for reuse as said fresh pulping liquor in step (f); and passing steam through said first extractor to strip residual solvent from said first charge, and condensing the stripped solvent vapors to obtain a condensate suitable for reuse as said fresh pulping liquor in step (f).

7. The process of claim 1 further comprising:

steam stripping at least a portion of said second used pulping liquor withdrawn in step (d) at subatmospheric pressure, removing and condensing the stripped solvent vapors to obtain a condensate suitable for reuse as said fresh pulping liquor in step (f), and separating the resultant residual slurry containing lignin solids and dissolved carbohydrates.

8. The process of claim 1 further comprising the steps of:

subjecting said second used pulping liquor withdrawn in step (d) at said predetermined pulping temperature and pressure to depressurization, and separating the resultant solvent vapors from residual used pulping liquor and being suitable for reuse as said first used pulping liquor in step (b);

condensing said solvent vapors to obtain a condensate suitable for reuse as said fresh pulping liquor in step (f); and steam stripping at least a portion of said residual used pulping liquor at subatmospheric pressure, removing and condensing the stripped solvent vapors to obtain a condensate suitable for reuse as said fresh pulping liquor in step (f), and separating the resultant residual slurry containing lignin solids and dissolved carbohydrates.

9. In a solvent extraction pulping process wherein lignin is extracted from subdivided fibrous plant material by contacting said material at an elevated pulping temperature and pressure with a solvent pulping liquor comprising an aqueous solution of a lower aliphatic alcohol, the improvement which comprises providing a plurality of batch extractors and carrying out the following sequential steps in each extractor:

(a) feeding a first charge of said subdivided fibrous plant material to a first extractor;

(b) filling said first extractor with a first used pulping liquor so as to displace air from said first extractor;

(c) introducing a second used pulping liquor of relatively high dissolved solids content at an elevated temperature and pressure into said first extractor so as to displace said first used pulping liquor, and recirculating said second used pulping liquor without separation of lignin at a relatively high velocity through said first extractor and through an external heat exchanger so as to effect rapid heating of said first charge to a predetermined pulping temperature of from about 160° to about 220° C. within not more than about 10 minutes at a predetermined pulping pressure of from about 10 to about 50 atmospheres, said second used pulping liquor being obtained from step (e), as hereinafter described, during pulping of another charge in a second extractor and being supplied from said second extractor to said first extractor without separation of lignin;

(d) continuing said recirculation of said second used pulping liquor without separation of lignin to effect essentially isothermal initial extraction of said first charge at said predetermined pulping temperature and pressure, and thereafter withdrawing said second used pulping liquor from said first extractor;

(e) flowing at least one additional used pulping liquor through said first charge in said first extractor on a once-through basis to effect essentially isothermal further extraction of said first charge at said predetermined pulping temperature and pressure, said additional used pulping liquor having a lower dissolved solids content than said second used pulping liquor and being obtained from step (f), as hereinafter described, during pulping of still another charge in a third extractor and being supplied from said third extractor to said first extractor without separation of lignin;

(f) flowing heated fresh pulping liquor through said first charge in said first extractor on a once-through basis to effect essentially isothermal final extraction of said first charge, said fresh pulping liquor being obtained at least in part, from steps (g), (h), (k), and (l), as hereinafter described;

(g) draining liquor from said first extractor, depressurizing said first extractor by releasing the solvent vapors therein to a condenser, and recovering condensed solvent suitable for reuse as said fresh pulping liquor in step (f);

(h) passing steam through said first extractor to strip residual solvent from said first charge, and condensing the stripped solvent vapors to obtain a condensate suitable for reuse as said fresh pulping liquor in step (f);

(i) discharging crude cellulose pulp from said first extractor;

(j) subjecting said second used pulping liquor withdrawn in step (d) at said predetermined pulping temperature and pressure to depressurization, and separating the resultant solvent vapors from residual used pulping liquor;

(k) condensing the solvent vapors from step (j) to obtain a condensate suitable for reuse as said fresh pulping liquor in step (f); and (l) steam stripping at least a portion of said residual used pulping liquor from step (j) at subatmospheric pressure, removing and condensing the stripped solvent vapors to obtain a condensate suitable for reuse as said fresh pulping liquor in step (f), and separating the resultant residual slurry containing lignin solids and dissolved carbohydrates.

10. The process of claim 9 wherein said alcohol is selected from the group consisting of methanol, ethanol, the propanols, and the butanols, and the concentration of said alcohol is from about 20% to about 80% by weight.

11. The process of claim 10 wherein the concentration of said alcohol is from about 40% to about 60% by weight.

12. The process of claim 9 wherein said predetermined pulping temperature is from about 180° to about 210° C. and said predetermined pulping pressure is from about 20 to about 35 atmospheres.

13. The process of claim 9 wherein each of said extractors comprises an elongated vertical tubular vessel, the pulping liquors being passed upwardly through said vessel, and said vessel having a height:diameter ratio between about 4:1 and about 15:1.

14. The process of claim 9 further comprising the steps of settling the residual slurry from step (1) to obtain a thickened lignin slurry and a supernatant liquor, centrifuging said thickened slurry to separate a lignin sludge from another supernatant liquor, combining said supernatant liquors, and concentrating the combined liquors by evaporation to obtain a carbohydrate concentrate.

15. The process of claim 14 wherein the solvent vapors from step (j) are condensed to provide heat for the evaporation.

16. The process of claim 9 wherein said residual used pulping liquor from step (j) is at a relatively low temperature and is supplied to step (b) as said first pulping liquor.

* * * * *